US007524218B2

(12) United States Patent
Okuyama

(10) Patent No.: US 7,524,218 B2
(45) Date of Patent: Apr. 28, 2009

(54) BOAT

(75) Inventor: Takashi Okuyama, Shizuoka-ken (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/523,920

(22) Filed: Sep. 20, 2006

(65) Prior Publication Data

US 2007/0082566 A1 Apr. 12, 2007

(30) Foreign Application Priority Data

Sep. 20, 2005 (JP) ..... 2005-272352

(51) Int. Cl.

| | |
|---|---|
| ***B63H 21/22*** | (2006.01) |
| ***B63H 23/00*** | (2006.01) |
| *B60W 10/04* | (2006.01) |
| *B63H 21/21* | (2006.01) |
| *B63C 1/02* | (2006.01) |
| *B60L 3/00* | (2006.01) |
| *B60L 15/00* | (2006.01) |
| *G05D 3/00* | (2006.01) |
| *G06F 7/00* | (2006.01) |
| *G06F 17/00* | (2006.01) |

(52) U.S. Cl. ..... 440/1; 84/85; 84/86; 84/87; 114/46; 701/21; 701/36

(58) Field of Classification Search ..... 440/1, 440/84–87; 114/146; 701/21, 36
See application file for complete search history.

(56) References Cited

U.S. PATENT DOCUMENTS

| | | | |
|---|---|---|---|
| 1,843,272 | A | 2/1932 | Ole Evinrude |
| 2,204,265 | A | 6/1940 | Wentzel |
| 2,466,282 | A | 4/1949 | Sparrow et al. |
| 2,740,260 | A | 4/1956 | Blanchard |
| 3,986,363 | A | 10/1976 | Beaman et al. |
| 4,412,422 | A | 11/1983 | Rossi |
| 4,622,938 | A | 11/1986 | Wenstadt et al. |
| 4,646,696 | A | 3/1987 | Dogadko |

(Continued)

FOREIGN PATENT DOCUMENTS

| | | |
|---|---|---|
| JP | 03-061196 | 3/1991 |

(Continued)

OTHER PUBLICATIONS

Product catalog of i6000TEC—Triple Engine Electronic Shift & throttle of Teleflex Morse Co., Ltd. (USA).

(Continued)

*Primary Examiner*—Lars A Olson
*Assistant Examiner*—Daniel V Venne
(74) *Attorney, Agent, or Firm*—Knobbe, Martens, Olson & Bear, LLP

(57) ABSTRACT

A boat can be provided with an electrically controlled outboard motor, or other type of propulsion unit, for producing thrust according to an operation of a remote control unit provided in a hull of the boat. The remote control ECU which can output a remote control operation signal can be provided in the remote control unit. An engine ECU which can receive the remote control operation signal and control the outboard motor, can be provided in the outboard motor. The remote control unit and the outboard motor can have respective connectors directly connected to each other via a DBW CAN cable.

7 Claims, 4 Drawing Sheets

U.S. PATENT DOCUMENTS 4,648,497 A 3/1987 Prince
4,747,381 A 5/1988 Baltz et al.
4,755,156 A 7/1988 Wagner
4,788,955 A 12/1988 Wood
4,801,282 A 1/1989 Ogawa
4,805,396 A 2/1989 Veerhusen et al.
4,809,506 A 3/1989 Lauritsen
4,810,216 A 3/1989 Kawamura
4,836,809 A * 6/1989 Pelligrino ..... 440/2
4,850,906 A 7/1989 Kanno et al.
4,858,585 A 8/1989 Remmers
4,898,045 A 2/1990 Baba
4,964,276 A 10/1990 Sturdy
5,004,962 A 4/1991 Fonss et al.
5,051,102 A * 9/1991 Onoue ..... 440/75
5,062,403 A 11/1991 Breckenfeld et al.
5,062,516 A 11/1991 Prince
5,065,723 A 11/1991 Broughton et al.
5,103,946 A 4/1992 Masters et al.
5,157,956 A 10/1992 Isaji et al.
5,167,212 A 12/1992 Peter et al.
5,273,016 A 12/1993 Gillespie et al.
5,318,466 A 6/1994 Nagafusa
5,381,769 A 1/1995 Nishigaki et al.
5,492,493 A 2/1996 Ohkita
5,539,294 A 7/1996 Kobayashi
5,595,159 A 1/1997 Huber et al.
5,664,542 A 9/1997 Kanazawa et al.
5,730,105 A 3/1998 McGinnity
5,749,343 A 5/1998 Nichols et al.
5,771,860 A 6/1998 Bernardi
5,782,659 A 7/1998 Motose
5,899,191 A 5/1999 Rabbit et al.
6,015,319 A 1/2000 Tanaka
6,026,783 A 2/2000 Nestvall et al.
6,058,349 A 5/2000 Kikori et al.
6,073,509 A 6/2000 Salecker et al.
6,073,592 A 6/2000 Brown et al.
6,095,488 A 8/2000 Semeyn, Jr. et al.
6,098,591 A 8/2000 Iwata
6,109,986 A 8/2000 Gaynor et al.
6,233,943 B1 5/2001 Beacom et al.
6,273,771 B1 * 8/2001 Buckley et al. ..... 440/84
6,280,269 B1 8/2001 Gaynor
6,351,704 B1 2/2002 Koerner
6,379,114 B1 4/2002 Schott et al.
6,382,122 B1 5/2002 Gaynor et al.
6,414,607 B1 7/2002 Gonring et al.
6,587,765 B1 7/2003 Graham et al.
6,612,882 B2 9/2003 Shidara et al.
6,704,643 B1 3/2004 Suhre et al.
6,751,533 B2 6/2004 Graham et al.
6,910,927 B2 * 6/2005 Kanno ..... 440/1
6,965,817 B2 11/2005 Graham et al.
7,121,908 B2 10/2006 Okuyama
7,142,955 B1 11/2006 Kern et al.
7,153,174 B2 * 12/2006 Takada et al. ..... 440/1
7,220,153 B2 5/2007 Okuyama
2003/0082962 A1 * 5/2003 Kanno ..... 440/2
2003/0092331 A1 5/2003 Okuyama
2003/0093196 A1 * 5/2003 Okuyama ..... 701/21
2004/0029461 A1 2/2004 Shomura
2005/0118895 A1 6/2005 Kanno et al.
2005/0245145 A1 11/2005 Takada et al.
2005/0286539 A1 12/2005 Okuyama
2006/0240720 A1 * 10/2006 Yamashita et al. ..... 440/1
2007/0082565 A1 4/2007 Okuyama
2007/0178780 A1 8/2007 Ito et al.
2007/0218785 A1 9/2007 Okuyama
2007/0227429 A1 10/2007 Okuyama et al.
2007/0232162 A1 10/2007 Okuyama et al.
2007/0249244 A1 10/2007 Watanabe et al.
2007/0250222 A1 10/2007 Okuyama et al.
2007/0270055 A1 11/2007 Ito et al.
2007/0282490 A1 12/2007 Ito et al.
2007/0293102 A1 12/2007 Okuyama et al.
2008/0003898 A1 1/2008 Watanabe et al.

FOREIGN PATENT DOCUMENTS

JP 2001-260986 9/2001
JP 2003-098044 4/2003
JP 2003-127986 5/2003
JP 2003-146293 5/2003
JP 2004-068704 3/2004
JP 2004-244003 9/2004
JP 2005-297785 10/2005
WO WO 2005-102833 11/2005

OTHER PUBLICATIONS

Barron, Jim. "Get on the Bus." Trailer Boats Magazine, Jun. 2000, p. 36.
Spisak, Larry. "Know it by Chart." Boating Magazine, May 2000, p. 100.
J.D. "Gains in technology will alter makeup of the . . . " Boating Industry International, Nov. 2000.
Declaration of Daniel J. Carr.
Denn, James. "Future boats sales will hinge on technology." Boating Industry International, Nov. 2000.
Hemmel, Jeff. "Information, Please—The digital boating revolution begins." Boating Magazine, Sep. 2000.
Kelly, Chris. "Can We Talk?" Power & Motoryacht Magazine, Jun. 2000, pp. 36 & 38, 39.
"Plug and Play" Advertisement from "Motorboating", Dec. 2000, p. 57.
"MagicBus i3000 Series Intelligent Steering" Instruction Manual. Telefex, Inc.

* cited by examiner

BOAT

PRIORITY INFORMATION

This application is based on and claims priority under 35 U.S.C. §119 to Japanese Patent Application No. 2005-272352, filed on Sep. 20, 2005, the entire contents of which is hereby expressly incorporated by reference herein.

BACKGROUND OF THE INVENTIONS

1. Field of the Inventions

The present inventions relate to boats having remote control units for electrically controlling propulsion units of the boats.

2. Description of the Related Art

In known conventional boats, an outboard motor can be used as a boat propulsion unit. Such outboard motors are usually provided at the stern of a hull of the boat, and a remote control unit can be provided in the vicinity of an operator's seat of the boat. When the remote control unit is operated, the throttle opening or other operation parameter of the engine of the outboard motor is controlled so that the outboard motor is driven at a desired speed, etc.

Examples of these types of boats include those disclosed in Japanese Patent Document JP-A-2003-127986, Japanese Patent Document JP-A-2003-98044, and U.S. Pat. No. 6,273,771, for example.

SUMMARY OF THE INVENTIONS

An aspect of at least one of the embodiments disclosed herein includes the realization that in conventional boat designs, such as those noted above, the cables connecting the remote controls and the respective ECUs of the propulsion units include multiple connection points along their length. Such use of multiple connection points provided along the cable between the two components make it less likely that the signals are exchanges stably, thereby reducing reliability. In the case where the users make such connections, there is an increased risk of incorrect connections and breakages.

Thus, in accordance with at least one of the embodiments disclosed herein, a boat can have an electrically controlled propulsion unit configured to produce thrust according to an operation of a remote control unit provided in a hull. The remote control unit can comprise a remote control body including a built-in remote control ECU configured to output a remote control operation signal. The propulsion unit can comprise a propulsion unit ECU configured to receive the remote control operation signal and to control the boat propulsion unit based on the signal, the remote control unit and the boat propulsion unit having respective connections directly connected to each other via a cable.

BRIEF DESCRIPTION OF THE DRAWINGS

The abovementioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION OF THE PREFERRED EMBODIMENT

Figure 1:
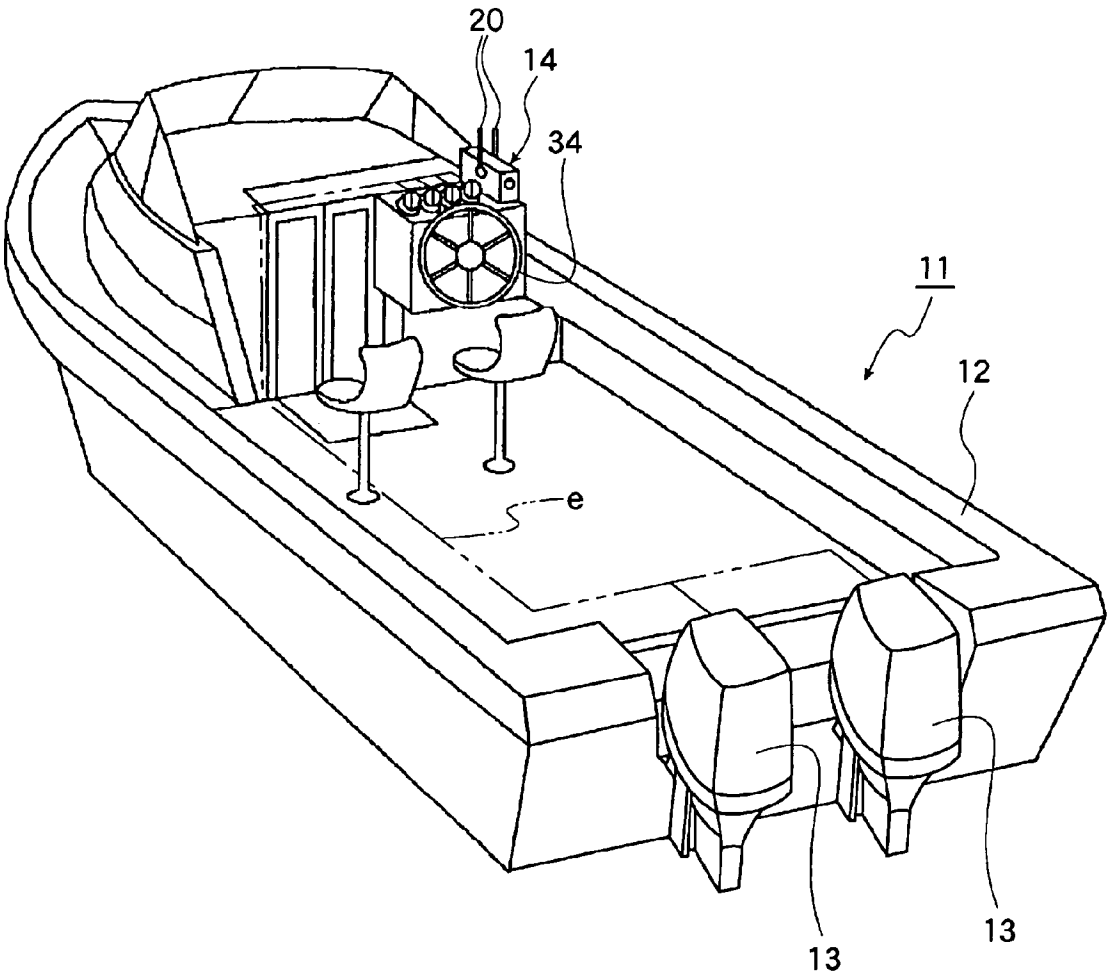
FIG. 1 is a perspective view of a boat according to an embodiment.

FIG. 1 is a schematic top, rear, and left side perspective view of a boat 11 including a wiring arrangement connecting a plurality of outboard motors. The embodiments disclosed herein are described in the context of a marine propulsion system of a boat because these embodiments have particular utility in this context. However, the embodiments and inventions herein can also be applied to other marine vessels, such as personal watercraft and small jet boats, as well as other land and marine vehicles. It is to be understood that the embodiments disclosed herein are exemplary but non-limiting embodiments, and thus, the inventions disclosed herein are not limited to the disclosed exemplary embodiments.

The boat 11 includes two outboard motors 13 serving as a "boat propulsion unit" attached to the stern of a hull 12. The outboard motors 13 can be operated through a remote control unit 14, a steering wheel unit 15 and a key switch unit 16 provided around an operator's seat.

Figure 2:
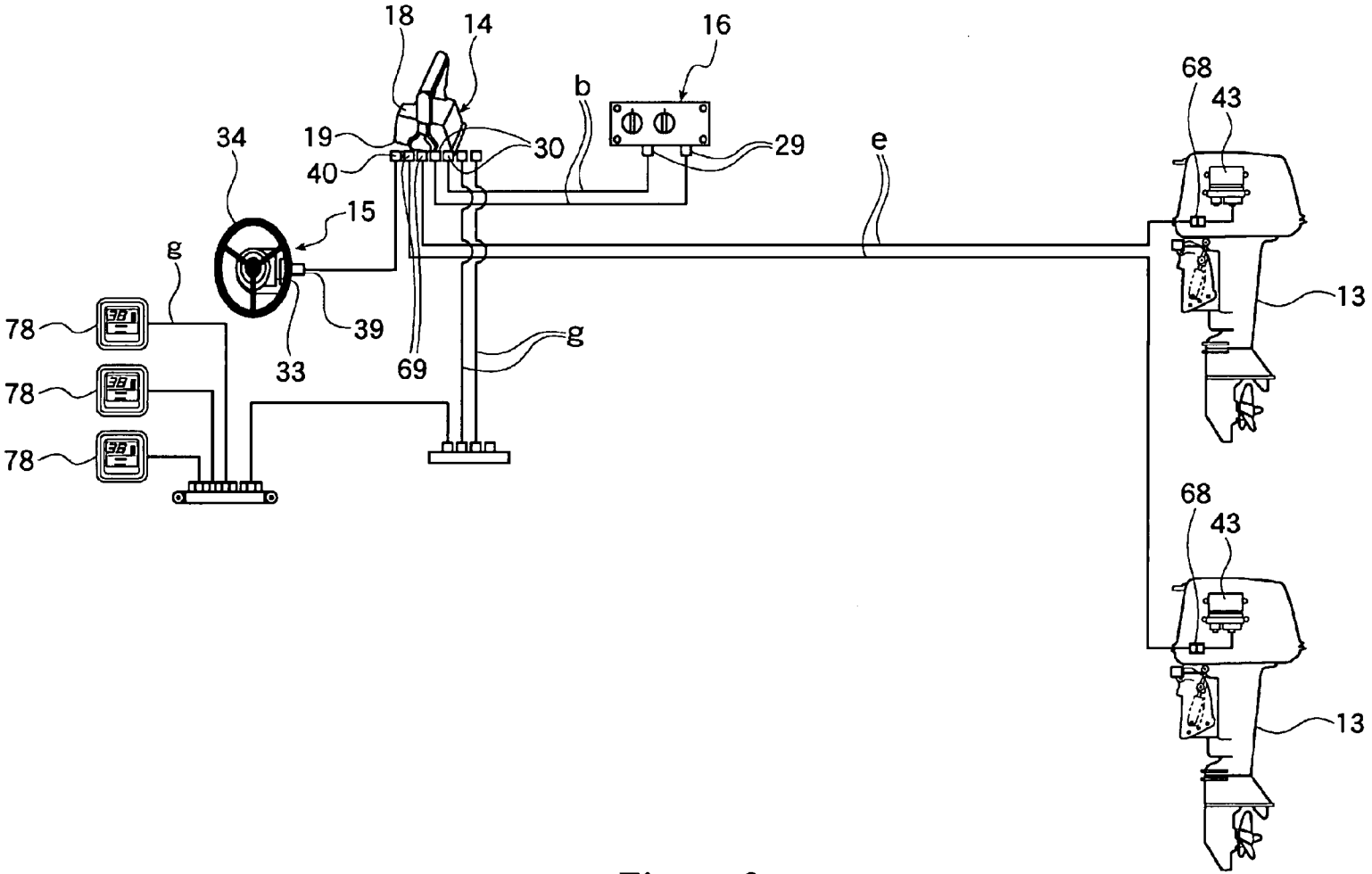
FIG. 2 is a schematic wiring diagram of a wiring system that can be used with the boat.

The remote control unit 14 can include two remote control ECUs 19 (FIG. 3) built in a remote control body 18, and two remote control levers 20 each connected to a position sensor 21 via a mechanical system cable "a" (FIG. 2). Each position sensor 21 can, in turn, be connected to the corresponding remote control ECU 19 via two analog signal cables "b". A PTT switch 22 can be connected to each remote control ECU 19 via an analog signal cable "b". The two remote control ECUs 19, 19 can be connected to each other via an inter-ECU communication cable "c".

The key switch unit 16 can be connected to the two remote control ECUs 19 of the control unit 14. The key switch unit 16 can include two start switches 25 and two main/stop switches 26 corresponding to the outboard motors 13. One start switch 25 and one main/stop switch 26 can be connected to one remote control ECU 19 via an analog signal cable "b", while the other start switch 25 and the other main/stop switch 26 can be connected to the other remote control ECU 19 via an analog signal cable "b". A one-touch start switch 27 can be connected to the one remote control ECU 19 via an analog signal cable "b".

As shown in FIG. 2, the analog signal cables "b" for connection between the start switches 25 and the remote control ECUs 19, and between the main/stop switches 26 and the remote control ECUs 19, can be disconnectable from the key switch unit 16 via connectors 29, and disconnectable from the remote control unit 14 via connectors 30.

Figure 3:
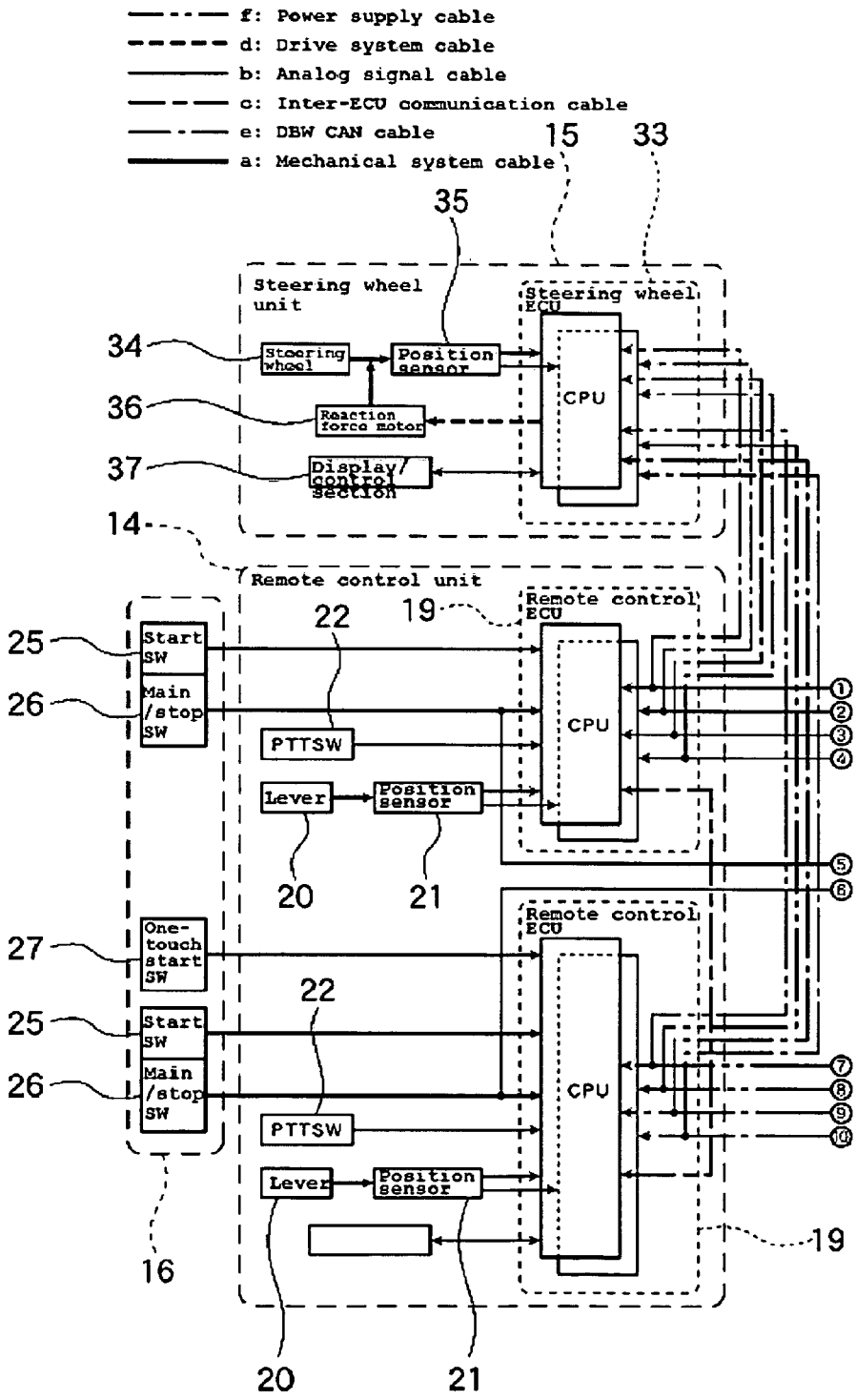
FIG. 3 is a block diagram of an arrangement of a remote control unit, a steering wheel unit, a key switch unit, etc. that can be used with the boat.
Figure 4:
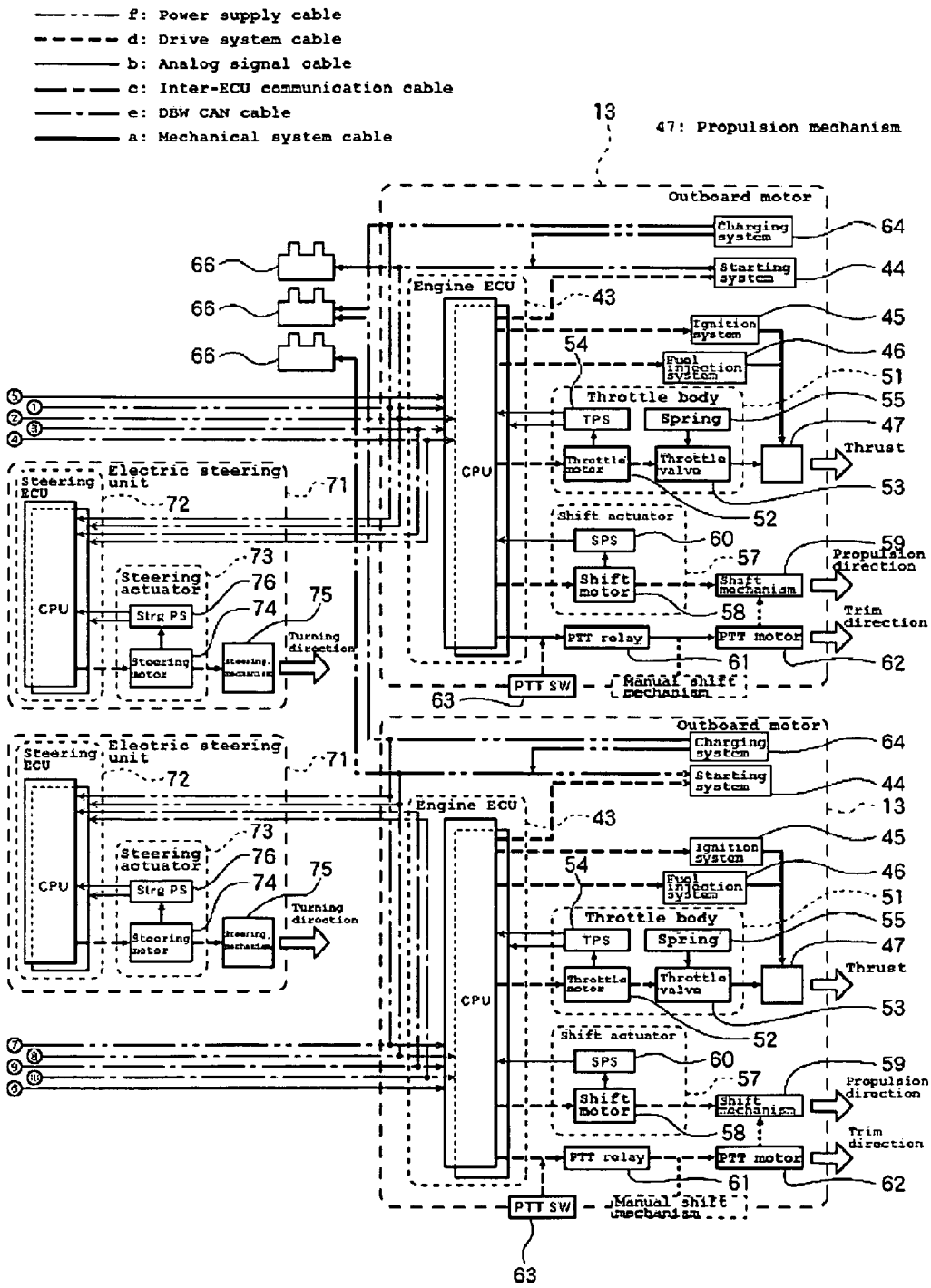
FIG. 4 is a block diagram of an arrangement of outboard motors, steering units etc. that can be used with the boat.

Also, as shown in FIG. 3, the steering wheel unit 15 can include a built-in steering wheel ECU 33 and a steering wheel 34. The steering wheel 34 can be connected via a mechanical system cable "a" to a position sensor 35 which can be configured to detect the position of the steering wheel 34.

The position sensor 35 can, in turn, be connected to the steering wheel ECU 33 via analog signal cables "b". To the steering wheel ECU 33 can also be connected a reaction force motor 36 configured to apply reaction forces to the steering wheel 34 via a drive cable "d", and a display/control section 37 for changing the mode of a steering system via an analog signal cable "b".

The steering wheel ECU 33 of the steering wheel unit 15 can be connected to the pair of remote control ECUs 19 of the remote control unit 14 each via two DBW CAN cables "e". Here, the term "CAN" is an abbreviation for "Controller Area Network".

As shown in FIG. 2, the DBW CAN cables "e" for connection between the steering wheel ECU 33 and the remote control ECUs 19 can be disconnectable from the steering wheel unit 15 via connectors 39, and disconnectable from the remote control unit 14 via connectors 40.

On the other hand, each outboard motor 13 includes an engine ECU 43 serving as a "propulsion unit ECU". The engine ECU 43 can be connected to a starting system (starter motor) 44, an ignition system (ignition plug) 45 and a fuel injection system (injector) 46 via drive system cables "d". A propulsion mechanism (engine) 47 can be driven by the starting system 44, the ignition system 45, the fuel injection system 46, etc. to produce thrust.

The engine ECU 43 can also be connected to a throttle motor 52 of a throttle body 51 via a drive system cable "d". The throttle opening of a throttle valve 53 can be controlled through the throttle motor 52 such that the propulsion mechanism 47 is driven at a desired speed. The throttle body 51 can also be provided with a throttle position sensor 54 configured to detect the throttle opening, and a spring 55 configured to urge the throttle valve 53 toward the closing direction. A signal from the throttle position sensor 54 can be input to the engine ECU 43.

In addition, a shift motor 58 of a shift actuator 57 can be connected to each engine ECU 43 via a drive system cable "d". The shift motor 58 drives a shift mechanism 59 to control the propulsion direction (in forward or reverse). The shift actuator 57 can be also provided with a shift position sensor 60 configured to detect the shift position. A signal from the shift position sensor 60 can be input to the engine ECU 43.

Further, a PTT relay 61 can be connected to each engine ECU 43 via a drive system cable "d". The PTT relay 61 can be connected to a PTT motor 62 via a drive system cable "d" so that the PTT motor 62 controls the trim direction. A PTT switch 63 can be connected to the PTT relay 61.

Each outboard motor 13 can be further provided with a charging system 64. The charging systems 64 are connected to batteries 66 via power supply cables "f".

The engine ECUs 43 of the two outboard motors 13 can be directly connected to the respective remote control ECUs 19 of the remote control unit 14 via DBW CAN cables "e".

As shown in FIG. 2, the DBW CAN cables "e" which can connect the engine ECUs 43 and the remote control ECUs 19 can also be disconnectable from the outboard motors 13 via connectors 68, and disconnectable from the remote control unit 14 via connectors 69.

The engine ECUs 43 of the two outboard motors 13 can each be connected to a steering ECU 72 of an electric steering unit 71 via DBW CAN cables "e". Each steering ECU 72 can be connected to a steering motor 74 of a steering actuator 73 via a drive system cable "d". The steering motor 74 can be configured to drive a steering mechanism 75 to turn the boat to a desired direction. The steering actuator 73 can be also provided with a steering position sensor 76 configured to detect the steering position. A signal from the steering position sensor 76 can be input to the steering ECU 72.

The batteries 66 can be connected to the ECUs 19, 33, 43, 72 via power supply cables "f".

As shown in FIG. 2, the boat 11 can be installed with an information system network separate from a DBW network. In the information system network, instrument panels 78 are connected to the remote control unit 14 via information system cables "g" so that the instrument panels 78 display the engine speed, etc.

During operation of the boat 11, firstly, when the start switch 25 is operated to start the outboard motor 13, a signal from the start switch 25 can be input via the remote control ECU 19 to the engine ECU 43. Then, the engine ECU 43 controls the starting system 44, the ignition system 45, the fuel injection system 46, etc. and opens the throttle valve 53 through the throttle motor 52, in order to drive the propulsion mechanism 47.

When the remote control lever 20 is operated while the outboard motor 13 is running, a signal from the position sensor 21 can be input to the remote control ECU 19. The remote control ECU 19 in turn sends the signal indicating the position of the remote control lever 20 to the engine ECU 43. Then, based on the position of the remote control lever 20, the engine ECU 43 controls the rotational movement of the throttle valve 53 through the throttle motor 52, in order to achieve desired thrust through the propulsion mechanism 47 and hence a desired boat speed.

In addition, the position of the remote control lever 20 can be detected, for example, whether it is in the forward, neutral or reverse position. Based on a signal indicating which position the remote control lever 20 is in, the engine ECU 43 controls the shift motor 58 so as to drive the shift mechanism 59, in order to determine the propulsion direction, etc.

Further, when the steering wheel 34 is rotationally moved in a certain direction to steer the boat 11, the steering wheel angle can be detected by the position sensor 35. Then, a signal indicating the steering wheel angle can be input via the steering wheel ECU 33 to the steering ECU 72. The steering ECU 72 controls the steering motor 74 so as to drive the steering mechanism 75 such that the outboard motor 13 is directed to the certain direction.

The two outboard motors 13 included in some embodiments can be synchronized with each other in terms of turning direction and thus can be controlled to turn to the same direction, although they can also be controlled independently of each other in terms of engine speed, propulsion direction, etc.

In the boat described above, the remote control ECU 19 provided in the remote control unit 14 and the engine ECU 43 provided in the outboard motor 13 are directly connected via the DBW CAN cables "e". Since plural connections (connectors) are not provided along the cables therebetween, unlike the conventional systems, the remote control ECU 19 and the engine ECU 43 can stably exchange signals with each other, thereby improving reliability.

In addition, the outboard motor 13 can be easily attached to and removed from the hull 12 by just connecting and disconnecting at two locations, namely the connectors 69 at the remote control unit 14 and the connectors 68 at the outboard motors 13. Thus, even users unaccustomed to the attachment work are less likely to make wrong connections.

Further, providing the remote control unit 14 with the remote control ECU 19 can improve the extensibility.

Furthermore, providing the remote control ECU 19 within the remote control body 18 can improve the appearance quality of the remote control unit 14.

The key switch unit 16 can be connected to the remote control ECU 19 so that start/stop signals can be sent via the remote control ECU 19 to the engine ECU 43. That is, the key switch unit 16 can just be connected to the remote control ECU 19 located in the vicinity of the key switch unit 16, and there is no need to install separate wiring connecting to the outboard motor 13. Therefore, the wiring work and wiring itself can be simplified.

The steering wheel ECU 33 provided in the steering wheel unit 15 can be connected to the remote control ECU 19 so that steering wheel angle signals are sent via the remote control ECU 19 to the steering ECU 72. That is, the steering wheel ECU 33 can just be connected to the remote control ECU 19 located in the vicinity of the steering wheel unit 15, and there is no need to install separate wiring connecting to the outboard motor 13. Therefore, the wiring work and wiring itself can be simplified.

In the case where the boat is provided with plural outboard motors 13, the embodiments disclosed above can be applied to further improve the reliability, the wiring workability, etc., compared to the conventional arts which make the structure more complex.

If the information system network is separate from the DBW network, possible damage to the information system network would not affect the DBW network, thereby further securing the reliability. The term "DBW" is an abbreviation for "Drive-By-Wire", and refers to a manipulation device through electrical connection instead of mechanical connection.

Two outboard motors 13 are provided in some the embodiments disclosed above. The present inventions are not limited thereto, but one outboard motor, or more than two outboard motors can also be used. Additionally, the phrase "boat propulsion unit" is not limited to the outboard motor 13, but may be an inboard-outboard motor, etc.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A boat having an electrically controlled propulsion unit configured to produce thrust according to an operation of a remote control unit provided in a hull, the remote control unit comprising a remote control body including a built-in remote control ECU configured to output a remote control operation signal, the propulsion unit comprising a propulsion unit ECU configured to receive the remote control operation signal and to control the boat propulsion unit based on the signal, the remote control unit and the boat propulsion unit having respective connections directly connected to each other via a cable, a key switch unit configured to start and stop the boat propulsion unit and connected to the remote control unit such that a signal for starting and stopping is sent to the remote control ECU, a second boat propulsion unit and at least a second remote control ECU corresponding to the second boat propulsion unit, wherein the boat propulsion unit and the second boat propulsion unit are directly connected to the remote control ECU and the second remote control ECU, respectively, in a one-to-one manner via a cable, wherein a steering wheel ECU is directly connected to each of the remote control ECU and the second remote control ECU via cables.

2. The boat according to claim 1 additionally comprising an instrument panel connected to the remote control unit via an information system cable.

3. A boat having an electrically controlled propulsion unit configured to produce thrust according to an operation of a remote control unit provided in a hull, the remote control unit comprising a remote control body including a built-in remote control ECU configured to output a remote control operation signal, the propulsion unit comprising a propulsion unit ECU configured to receive the remote control operation signal and to control the boat propulsion unit based on the signal, the remote control unit and the boat propulsion unit having respective connections directly connected to each other via a cable, at least a second boat propulsion unit and at least a second remote control ECU corresponding to the second boat propulsion unit, wherein the boat propulsion unit and the second boat propulsion unit are directly connected to the remote control ECU and the second remote control ECU, respectively, in a one-to-one manner via a cable, wherein a steering wheel ECU is directly connected to each of the remote control ECU and the second remote control ECU via cables.

4. The boat according to claim 3, wherein the connections comprise connectors.

5. The boat according to claim 3 additionally comprising an instrument panel connected to the remote control unit via an information system cable.

6. A boat having an electrically controlled propulsion unit configured to produce thrust according to an operation of a remote control unit provided in a hull, the remote control unit comprising a remote control body including a built-in remote control ECU configured to output a remote control operation signal, the propulsion unit comprising a propulsion unit ECU configured to receive the remote control operation signal and to control the boat propulsion unit based on the signal, the remote control unit and the boat propulsion unit having respective connections directly connected to each other via a cable, a steering wheel unit configured to control steering the boat propulsion unit including a steering wheel ECU configured to receive steering wheel position information, and the steering wheel unit and the remote control unit have respective connections directly connected to each other via a cable, at least a second boat propulsion unit and at least a second remote control ECU corresponding to the second boat propulsion unit, wherein the boat propulsion unit and the second boat propulsion unit are directly connected to the remote control ECU and the second remote control ECU, respectively, in a one-to-one manner via a cable, and wherein the steering wheel ECU is directly connected to each of the remote control ECU and the second remote control ECU via cables.

7. The boat according to claim 6 additionally comprising an instrument panel connected to the remote control unit via an information system cable.

* * * * *